US008474477B1

(12) United States Patent
Melisz, Jr.

(10) Patent No.: US 8,474,477 B1
(45) Date of Patent: Jul. 2, 2013

(54) WATER-TIGHT SUMP-PUMP BASIN COVER BACK-UP DEVICE

(76) Inventor: Edward P. Melisz, Jr., Grand Island, NY (US)

( * ) Notice: Subject to any disclaimer, the term of this patent is extended or adjusted under 35 U.S.C. 154(b) by 77 days.

(21) Appl. No.: 12/133,794

(22) Filed: Jun. 5, 2008

Related U.S. Application Data

(63) Continuation of application No. 60/942,348, filed on Jun. 6, 2007.

(51) Int. Cl.
*E02D 29/14* (2006.01)

(52) U.S. Cl.
USPC ..... 137/363; 52/169.5

(58) Field of Classification Search
USPC ..... 137/363, 364, 371, 565.337; 417/2, 417/62, 426; 52/169.5
See application file for complete search history.

(56) References Cited

U.S. PATENT DOCUMENTS 1,886,444 A * 11/1932 Wurster ..... 116/276
3,941,507 A * 3/1976 Niedermeyer ..... 417/2
4,080,989 A 3/1978 Chapelsky et al.
4,456,432 A * 6/1984 Mannino ..... 417/2
4,865,069 A * 9/1989 Lacey ..... 137/132
4,890,425 A 1/1990 Mamula
5,927,955 A 7/1999 Janesky
5,954,103 A * 9/1999 Smith ..... 141/86
6,276,093 B1 8/2001 Janesky
6,305,410 B1 * 10/2001 Cook et al. ..... 137/363
6,364,620 B1 * 4/2002 Fletcher et al. ..... 417/36
2004/0094209 A1 * 5/2004 Harwood ..... 137/565.29
2005/0034383 A1 * 2/2005 Allen ..... 52/200

* cited by examiner

*Primary Examiner* — John Fox
(74) *Attorney, Agent, or Firm* — Patricia H. Costanzo

(57) ABSTRACT

A watertight, multi-sectioned, sump-pump basin cover back-up device made of a first cover section defining an outer-rim having a central aperture for accepting a water tightly sealable second cover section having at least one opening there-through for accepting a water-tightly sealable discharge pipe, another water-tight, uncoverable, covered aperture for drainage of water from the floor adjacent to the sump-pump basin into the basin only when the water-tight cover is removed, and an auxiliary discharge pipe having a predetermined height, providing for said pipe to function as a relief valve. The device fixedly or detachably attachable to a sump pump basin rim, reducing or eliminating sump-pump cavity overflow flooding, while retarding the escape of pump noise, odor, and gases known to emanate from sump-pump basins.

9 Claims, 2 Drawing Sheets

WATER-TIGHT SUMP-PUMP BASIN COVER BACK-UP DEVICE

CROSS-REFERENCE TO RELATED APPLICATIONS

The present application claims the benefit of Provisional Application No. 60/942,348 filed on Jun. 6, 2007.

STATEMENT REGARDING FEDERALLY SPONSORED RESEARCH OR DEVELOPMENT

Not Applicable

REFERENCE TO SEQUENCE LISTING, A TABLE OR A COMPUTER PROGRAM LISTING COMPACT DISK APPENDIX

Not Applicable

BACKGROUND

The present invention relates generally to avoiding the flooding caused by the failure of sump-pumps and, more particularly, to a water-tight, non-mechanical, sump-pump cover back-up device that reduces or eliminates flooding caused by overflow sump-pump discharge, as well as by flooded floors adjacent to the sump-pump basin.

The background information discussed below is presented to better illustrate the novelty and usefulness of the present invention. This background information is not admitted prior art.

A sump basin is generally a holding cavity formed by digging a recess into the basement floor and is often referred to as a sump-pump basin. The sump-pump basin acts both to house the sump-pump and to collect water that could otherwise flood the basement. It is the pumping action of the sump-pump that removes any water accumulating in the sump-pump basin. Water accumulates in the sump-pump basin when, for example, excessive amounts of rain or excess ground water flow over saturates the soil adjacent to the building foundation. Water also may enter the basin via drain pipes that have been placed into the ground around the perimeter of a building to divert any excess water into the basin before it can began to permeate the foundation walls, or water may find its way into the sump-pump basin through porous or cracked basement walls. Sump-pumps are ubiquitous in areas where basement flooding is a recurring problem. When a sump-pump pumps water out of the sump-pump basin, it delivers the pumped water to an area away from the building, such as a municipal storm drain or a dry well, so that the water will no longer present a problem.

Sump-pumps are usually hardwired into a home's electrical system. However, in the event that there is an electricity outage, such as during a heavy rain storm, which may be just when a functioning sump-pump is needed the most, or if the main pump fails for any other reason, the system ideally also provides for a sump-pump backup to prevent sump basin overflow that is likely to occur if the water in the basin is not constantly pumped. The backup system may comprise a secondary battery or water powered sump-pump, for example.

In the United States, modern sump-pump components are standardized and include: a plastic or metal canister forming a liner for the sump-pump basin, which may be, for example, approximately 2 feet (0.6 m) across and 2 to 3 feet (0.6 to 1 m) deep, 15 to 25 US gallons (60 to 100 L); a sump-pump, generally either ⅓ or ½ horsepower (200 or 400 W), which may be either battery or electrically powered (or both), and a set of pipes, typically 1.5 inch (38 mm) PVC, that are routed from the pump, through a check valve, and out of the house. A check valve allows water to flow up and out through the pipes, but will not allow the water in the pipes to flow back into the sump basin when the pump is turned off. Typically, currently available sump basin covers are used so that mice, cats, etc., don't fall into the sump and drown and to keep gases, such as radon, from entering the basement.

The currently available sump-pump covers, although seemingly adequate for keeping animals or people from falling into the basin and for keeping gases from entering the basement, cannot keep excess sump basin water from escaping from the sump basin and flooding the basement. Heavy rains and rapid snow melts overwhelming the sump-pumps, failure of the main pump, and/or failure of the backup pump can all result in basement flooding due to failed sump-pump action. The amount of water that enters basements from overwhelmed or failed sump-pumps can vary from less than an inch to more than several feet. The damage caused by sump basin overflow is often considerable. Commonly, insurance companies will not write policies that cover water damage from flooded basements, and when they do, the premiums are high and the coverage limited. Accordingly, what is desperately needed is a back-up device that reduces or completely eliminates basement flooding and that can provide for pumping of water out of the sump pump, as well as for accepting water that accumulates on the floor adjacent to the sump pump basin. It would be desirable to have such a back-up device that has no moving parts to lead to failure and to avoid cost of replacement at best or flooding at worst, and that requires no power, will likely last the life of a home, in addition to, keeping animals or people from falling into the basin or being exposed to electrical hazards, and reducing or eliminating the noxious gases, including radon, from entering the basement from the sump pump basin.

SUMMARY

Accordingly, the present invention makes available a back-up device for sump pumps in the form of a water-tight sump basin cover that prevents water that may accumulate in the sump pump basin from backing up onto a basement, or other, floor. The sump-pump cover, as taught, also provides a drain having a removable, water-tight cover for the drainage of water from the floor into the sump pump basin when required and when the water-tight cover is removed.

The combination of the water-tight sump basin cover and a sump pump provides for pumping all excess water out of the basin to an off-site location. The combination also provides for an auxiliary pump, a water alarm, and transparent pipes with pre-determined water levels for monitoring of the height of excess water levels and providing for the pipe to function as a relief value. The water-tight sump pump cover has no moving parts that could lead to failure and result in replacement cost of replacement, at best, or flooding, at worst, requires no power, thus will likely last the life of a home. In addition, the sump pump cover as taught herein, prevents animals or people from falling into the basin or being exposed to electrical hazards, and reduces or eliminates the noxious gases, including radon, from entering the basement from the sump pump basin.

The foregoing is presented by providing for a sump-pump basin cover back-up device, comprising a water-tight, non-mechanical, sump-pump basin cover back-up device, where the basin cover is constructed for acceptance into and being water-tightly sealed to a rim of a sump-pump opening in a concrete floor surrounding the sump-pump basin, further comprising, a first aperture through the cover to receive and engage in a water-tight manner a discharge pipe through which water in the sump-pump basin is pumped to an outside drain by a sump pump providing for a water-tightly sealed water-tight sump-pump basin cover back-up device that reduces or prevents water in the sump-pump basin from flooding the floor adjacent to the sump-pump basin, while retarding the escape of pump noise, odor, and radon and other gases that are known to emanate from sump-pump basins.

a second aperture therethrough, the second aperture covered by a removable water-tight cover providing for drainage of water from the floor adjacent to the sump-pump basin into the sump-pump basin when, and only when, the water-tight cover is removed.

Additionally, the sump-pump cover device further comprises at least two cover sections, at least one being independently removable from the sump pump basin opening to provide access to the interior thereof.

where the at least two cover sections further comprise, a first cover section, and a second cover section providing for a framing outer-ring coverplate to be received by and water-tightly sealed to a rim of a sump pump basin opening in a concrete floor surrounding the sump-pump basin, the second cover section having a second aperture located therethrough for receiving and being water-tightly sealed to the first cover section.

where the one of the at least two cover sections containing the first aperture for the passage of the discharge pipe may be either the first section or the second section.

further comprising an auxiliary discharge pipe having a predetermined height, providing for the pipe to function as a relief valve.

Moreover, the device comprises wherein the second section is functionally constructed to be detachably attachable to the rim of the sump pump basin opening in the concrete floor or to be fixedly attached to the sump pump basin opening in the concrete floor.

Furthermore, the present invention teaches a sump-pump basin cover back-up device in conjunction with a sump pump, comprising:

a water-tight, non-mechanical, sump-pump basin cover back-up device, the cover structurally constructed for being accepted into and water-tightly sealed to a rim of a sump-pump opening in a concrete floor surrounding the sump-pump basin, further comprising, a first aperture through the cover to receive and engage in a water-tight manner a discharge pipe through which water in the sump-pump basin is pumped by a sump pump to an outside drain providing for a water-tightly sealed water-tight sump-pump basin cover back-up device that reduces or prevents water in the sump-pump basin from flooding the floor adjacent to the sump-pump basin, while retarding the escape of pump noise, odor, and radon and other gases that are known to emanate from sump-pump basins, and a sump pump operatively situated within the sump-pump basin and functionally connected to the discharge pipe, and a second aperture therethrough, the second aperture covered by removable water-tight cover providing for the drainage of water from a floor surface adjacent to the sump-pump basin into the sump-pump basin when, and only when, the cover is removed.

The cover further comprises at least two cover sections, at least one of which is independently removable from the sump pump basin to provide access to the interior thereof.

Additional features of the present invention include a water alarm as a safeguard against a pump failure, an auxiliary power sump-pump operatively situated within the sump-pump basin functionally connected to an auxiliary discharge pipe, wherein the auxiliary discharge pipe is made of transparent material to monitor the level of the water, wherein the auxiliary discharge pipe has a predetermined height, providing for the pipe to function as a relief value, and wherein the auxiliary discharge pipe further comprises a siphoning port to provide for the removal of water from the sump-pump basin.

BRIEF DESCRIPTION OF THE DRAWINGS

In order that these and other objects, features, and advantages of the present invention may be more fully comprehended and appreciated, the invention will now be described with reference to a specific exemplar embodiment, which is illustrated in appended drawings, wherein like reference characters indicate like parts throughout the several figures. It should be understood that these drawings depict a preferred embodiment of the present invention and are therefore not to be considered limiting in scope. The variations that the invention can take will be discussed below. The invention will now be described and explained with additional specificity and detail through the use of the accompanying drawings, in which.

Figure 1:
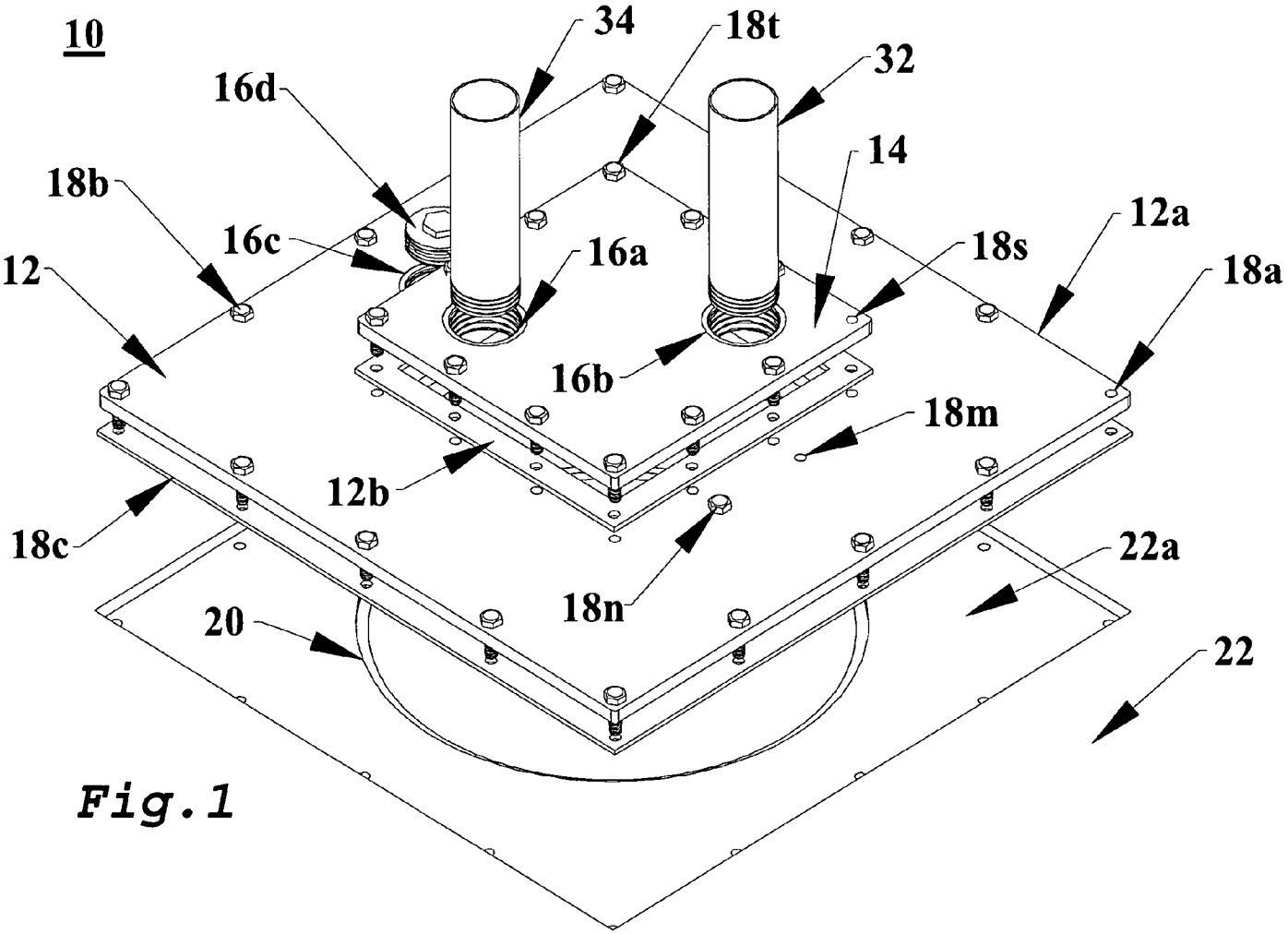
FIG. 1 is a perspective view of a sump-pump cover according to the principles of the present invention.

It should be understood that the drawings are not necessarily to scale. In certain instances, details which are not necessary for an understanding of the present invention or which render other details difficult to perceive may have been omitted.

A LIST OF REFERENCE NUMERALS AND THE PARTS TO WHICH THEY REFER

10 Sump-pump basin cover.
12 Ring-like outer-coverplate of sump-pump basin cover 10.
12*a* Outside perimeter of outer plate of sump-pump basin cover 10.
12*b* Rim of centrally located aperture of outer-coverplate 12.
14 Removable inner-coverplate of sump-pump basin cover 10.
16*a* Aperture for receiving sump-pump pipe 34.
16*b* Aperture for receiving sump-pump auxiliary discharge pipe 32.
16*c* Aperture for receiving sump-pump floor drain pipe 16*e*.
16*d* Watertight cover for floor drain pipe 16*e*.
16*e* Drain pipe.
18*a* Aperture for receiving bolt 18*b*.
18*b* Bolt for securing fixed outer plate of sump-pump basin cover 10.
18*c* Gasket.
18*m* Aperture for receiving bolt 18*n*.
18*n* Bolt for securing support bracket 74 to fixed outer plate 12.
18*p* Nut.
18*s* Aperture for receiving bolt 18*t*.
18*t* Bolt for securing removable inner plate of sump-pump basin cover 10 to fixed outer plate 12.

20 Sump-pump basin.
22 Concrete floor.
22*a* Recessed support shelf in concrete floor 22.
30 Upper transparent pipe for holding power lines and discharge pipe 75.
31 Coupler that couples upper opaque pipe 30 to lower transparent pipe 32.
31*b* Standard hose connection for siphoning.
31*c* Dip tube connected to 32.
32 Lower opaque pipe for holding power lines and discharge pipe 75.
34 Lower opaque pipe for holding main sump discharge pipe 44.
40 Upper discharge pipe for primary sump-pump.
42 Elbow Y-connector.
44 Lower discharge pipe for primary sump-pump.
46 Check value.
48 Rubber reducer/coupler.
50 Vent to outdoors.
60 Primary sump-pump.
62 Drain tile.
64 Power line for primary sump-pump.
70 Auxiliary sump-pump.
72 Power line for auxiliary sump-pump.
74 Support bracket for auxiliary sump-pump.
75 Discharge pipe for auxiliary sump-pump.
76 Discharge pipe with transparent pipe 32 and opaque pipe 30.
80 Gravel sub-floor.
90 Water alarm.
92 Water alarm sensor wire.

DETAILED DESCRIPTION

Referring now, with more particularity, to the drawings, it should be noted that the disclosed invention is disposed to embodiments in various sizes, shapes, and forms. Therefore, the embodiments described herein are provided with the understanding that the present disclosure is intended as illustrative and is not intended to limit the invention to the embodiments described herein.

The present invention teaches a water-tight sump-pump basin cover back-up device that reduces or eliminates flooding of basements caused by the overflow of water from a sump-pump basin. The water-tight sump basin cover keeps water from overflowing the sump-pump basin and flooding the floor adjacent to the sump-pump basin. The cover can also be utilized to allow water flooding the floor adjacent the basin to gravity flow into the basin to be pumped to an off-site destination. The cover also keeps animals or people from falling into the basin or being exposed to an electrical hazard. The cover, at taught, is water tight, has no moving parts to lead to pump failure and cost of replacement at best or flooding at worst, requires no power, will likely last the life of a home, and will prevent most occurrences of flooded basements. It should be noted that the invention is not meant to be limited by either size or shape. The cover is contemplated to be of any required size or shape, as neither size nor shape affects the working of the cover.

FIG. 1, an overhead plan view, illustrates watertight sump-pump basin cover 10 according to the principles of the present invention. Cover 10 comprises two cover sections, "framing" outer-coverplate 12 and inner-coverplate 14. Outer-coverplate 12 has an aperture that is to receive and to be water-tightly detachably attachable to inner-coverplate 14. In the embodiment illustrated, the aperture of outer-coverplate 12, a centrally located, but could be located in other positions, as well. The access aperture of outer-coverplate 12 provides for easy access into the sump-pump cavity, when required. Outer-coverplate 12 is attached, detachably or permanently, as desired, to a basement or other ground-level floor, that is the basin cover is constructed for being accepted into and water-tightly sealed to a rim of a sump-pump opening in a concrete floor surrounding the sump-pump basin, while inner-coverplate 14 is detachably but securely attached to rim 12*b* of outer-coverplate 12. FIG. 1 illustrates outer-coverplate 12 about to be set onto recessed support shelf 22*a* of floor 22 and inner-coverplate 14 positioned just above rim 12*b* that outlines aperture 12*b* of outer-coverplate 12 for placement into the aperture of outer-coverplate 12. Each plate, in this example, exhibits a square-shaped outer perimeter. The shape and size of the outer perimeter of either outer-coverplate 12 and/or detachable inner-coverplate 14 is not intended to limit the invention. Any and all shapes and sizes that will work to cover a sump-pump basin in a watertight manner are contemplated by the present invention. Additionally, the outer perimeters of the two coverplates can be made in shapes different from each other. For example, it is contemplated that the shape of the outer perimeter of outer-coverplate 12 be rectangular while the shape of the aperture outer-coverplate 12 and of outer perimeter of detachable inner-coverplate 14 is round.

Figure 2:
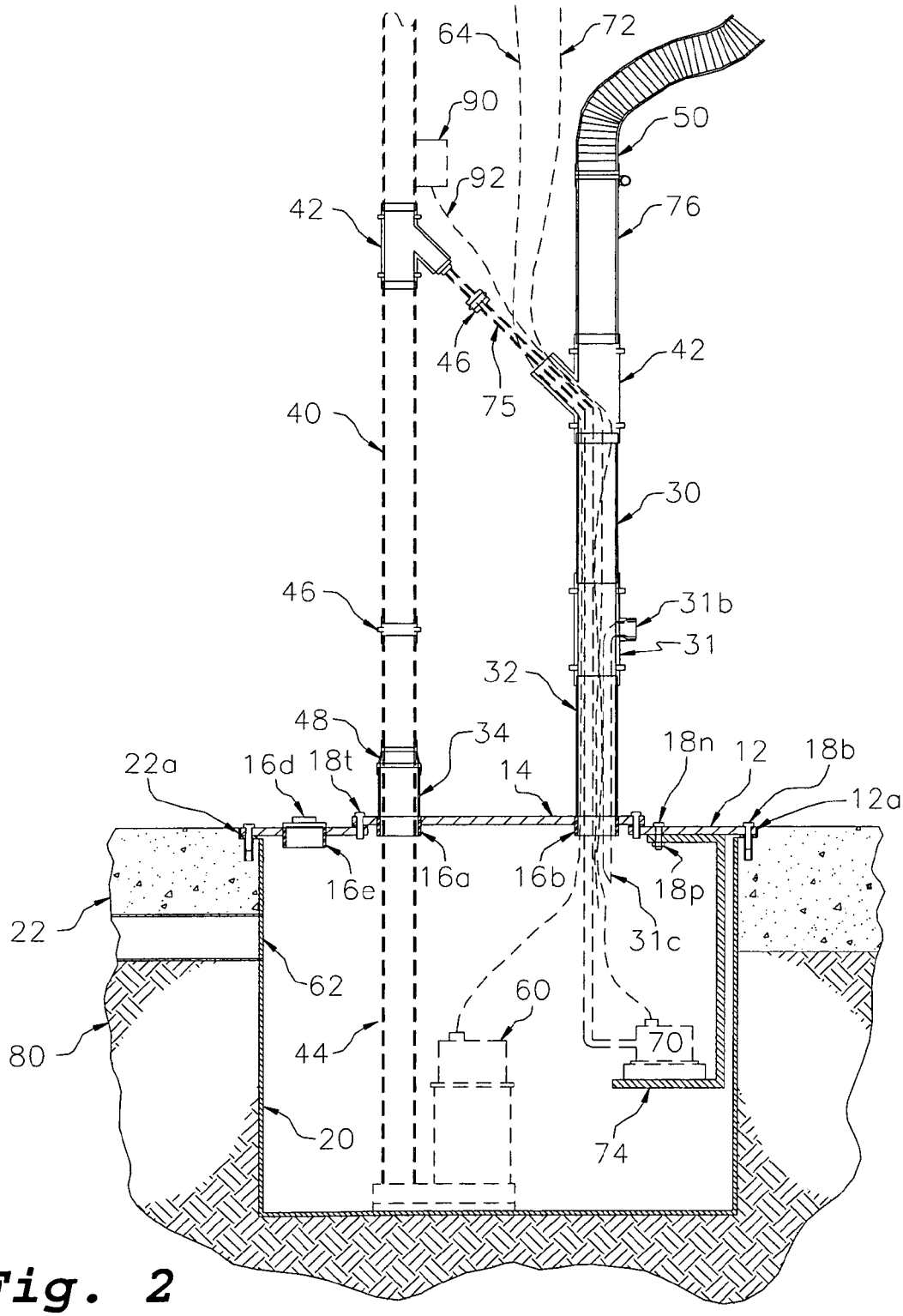
FIG. 2 is a side, partial, cross-sectional view of the sump-pump cover in use, as illustrated in FIG. 1, installed over a sump-pump cavity.

FIG. 2, a partial cross-sectional view, illustrates a favored embodiment of the present invention in use with outer plate 12 securely, but detachably fixed to a basement floor using bolts, for example, that are secured through bolt hole apertures 18*a* that are positioned about perimeter 12*a* outer-coverplate 12. There are many other means of affixing such objects, and as such affixing means are well-known in the art, they need not be discussed any further here, except for stating that all of the means that would accomplish the same attachment, including all those that are as yet unknown, are all within the scope of the invention. Outer-coverplate 12 has an aperture, designed to be an access opening having perimeter 12*b*. Outer-cover plate 12, thus, forms a frame-like partial covering over a sump-pump basin. Bolting outer-coverplate 12 to the floor provides for the plate to be unbolted. Alternatively, outer plate 12 is contemplated to be permanently affixed to the basement floor, if for example outer-coverplate 12 is fixed in the floor by installing plate 12 into the floor as the concrete forming the floor is being poured. In either case, the access opening of plate 12 defined by aperture rim 12*b* in the illustration provides for easy access into the interior of the sump-pump basin. Access may be needed to make repairs, for example. A water tight cover over the sump-pump cavity is formed when inner-coverplate 14 is positioned over inside perimeter rim 12*b* of the access opening of outer-coverplate 12 and detachably attached to the coverplate using bolts, for example, secured through bolt holes apertures 18*s*. Outer-coverplate 12 may have at least one additional opening 16*c* for receiving a drainage pipe, as illustrated. Opening 16*c* has a removable watertight cover 16*d*. Here, as illustrated, opening 16*c* is provided for use as a floor drain. Occasionally, the basement might have water that did not come up from the sump basin and needs to be drained into the sump basin so that the sump-pump can pump the water outside of the building. Such water might come from broken pipes or an overflowing washing machine, for example. Inner plate 14, as illustrated, has two openings, opening 16*a* to accommodate the primary pump's discharge pipe and opening 16*b* to accommodate the auxiliary pump's discharge pipe along with any power lines required for powering the primary pump and/or the accessory pump.

FIG. 2 further illustrates perimeter support rim 12*a* of fixed outer plate 12 supported by and attached to 22*a* recessed support shelf 22*a* of basement floor 22 via bolt 18*b* and gasket 18*c*. Basement floor 22 is underlain by a bed of drainage gravel 80. Installed within drainage gravel 80, at some required distance below floor 22, are drain tiles 62. The purpose of both drainage gravel 80 and drain tiles 62 is to provide easy access flow paths for excess ground water to get into sump-pump basin 20.

Inner plate 14 is shown detachably attached to outer-coverplate 12 via bolts 18*t* positioned through apertures 18*m* and gaskets. As mentioned earlier, inner plate 14 is easily attached to and detached from outer-coverplate 12 to provide easy and rapid access to basin 20 if and when required. When inner plate 14 is attached to outer-coverplate 12 the resulting cover provides for a watertight cover over the sump basin.

Primary sump-pump 60, as illustrated, sits on the floor of the basin and pumps water up and out of the basin through lower discharge pipe 44, which is fitted through opening 16*a* of inner plate 14, to upper discharge pipe 40 to be discharged to a site outside of the building. Installed through opening 16*c* (as shown in FIG. 1) in outer-coverplate 12 is drain pipe 16*e* covered by detachable watertight cover 16*d* providing for the drainage of water from the basement floor into sump basin 20 when, and only when, the cover is removed. Power connection cord 64 for primary sump-pump 60, in this example, extends through transparent lower extension pipe 32 to opaque upper extension pipe 30 to connect to a power outlet.

Auxiliary power sump-pump 70 is illustrated supported by support bracket 74 secured to outer-coverplate 12 via bolt 18*n* and nut 18*p*. Auxiliary sump-pump 70 pumps water up and out of the basin through discharge pipe 75 that in this example is coupled via elbow Y-connector 42 to primary discharge pipe 44. Discharge pipe 75 extends through the elbow of elbow Y-connector 42 to opaque upper extension pipe 30 and through transparent lower extension pipe 32 to connect to auxiliary sump-pump 70. Coupler 31 connects opaque upper extension pipe 30 to transparent lower extension pipe 32. Coupler 31 houses orifice 31*b* with a hose fitting to manually siphon water from the sump-pump by way of dip tube 31*c*. Together, extension pipes 30 and 32 produce discharge pipe 76 that houses wire 64 and wire 72 and auxiliary pump 75 and acts as the conduit for vent pipe 50 to vent fumes and gases outdoors. Lower extension pipe 32 extends into basin 20 through opening 16*b* of inner plate 14. The main pump discharge pipe comprising pipe sections 44 and 40 is made watertight by means of rubber coupler 48 clamped to conduit 34. Discharge pipe 76 comprising transparent lower extension pipe 32, opaque upper extension pipe 30 along with coupling 31 and elbow Y-connector 42 is made watertight by "welding" all the connections with PVC cement. In the example provided, the welding is accomplished using a PCV adhesive to seal the fittings, which is a well-known way to seal pumping fittings. The height of discharge pipe 76 is determined in each case according to the maximum height that flood waters are known or suspected of rising to in basements in a particular location. For example, if the sump-pump system is installed in an area that is known to receive up to four feet of flood water in the basements located in that area, pipe 76 would extend a minimum of four feet from the upper surface of inner plate 14 providing for the pipe to function as a relief valve. Lower section 32 of pipe 76 is made of transparent material, such as transparent PVC in this example to allow the level of water in the pipe to be monitored. Auxiliary sump-pump 70 may be powered by battery, gasoline, running water, or any other known, or yet to be known, means of powering an auxiliary pump. Power line 72 extends from auxiliary pump 70 through transparent lower extension pipe 32 and opaque upper extension pipe 30 to connect to a power source.

A float switch is used to sense the level of liquid within a tank. The switch may actuate a pump, an indicator, an alarm, or other device. Float switches range from small to large and may be as simple as a mercury switch inside a hinged float or as complex as a series of optical or conductance sensors producing discrete outputs as the liquid reaches many different levels within the tank. Perhaps the most common type of float switch is simply a float raising a rod that actuates a microswitch. A very common application is in sump-pumps where the switch detects the rising level of liquid in the sump or tank and energizes an electrical pump which then pumps liquid out until the level of the liquid has been substantially reduced, at which point the pump is switched off again. Float switches are often adjustable and can include substantial hysteresis. That is, the switch's "turn on" point may be much higher than the "shut off" point. This minimizes the on-off cycling of the associated pump. Some float switches contain a two-stage switch. As liquid rises to the trigger point of the first stage, the associated pump is activated. If liquid continues to rise because the pump has failed or its discharge is blocked, for example, the second stage will be triggered. This stage may switch off the source of the liquid being pumped, trigger an alarm, or both. Thus the float switch, as long as it does not fail, offers a great deal of protection against accidental sump-pump cavity overflow. In the event the float switch fails, the present invention provides for a water alarm 90, here shown, for example, attached to discharge pipe 40 to notify those in charge that water is accumulating in the cavity and immediate attention to the sump system is required.

Thus it has been shown how the present invention provides for a sump-pump cavity cover that eliminates or reduces floods caused by overflow sump-pump discharge has been developed. Moreover, as the watertight sump-pump basin cover of the present invention utilizes no moving parts and given correct installation, the cover should last for the lifetime of the building with the exception of an occasional gasket replacement.

The foregoing description, for purposes of explanation, uses specific and defined nomenclature to provide a thorough understanding of the invention. However, it will be apparent to one skilled in the art that the specific details are not required in order to practice the invention. Thus, the foregoing description of the specific embodiment is presented for purposes of illustration and description and is not intended to be exhaustive or to limit the invention to the precise form disclosed. Those skilled in the art will recognize that many changes may be made to the features, embodiments, and methods of making the embodiments of the invention described herein without departing from the spirit and scope of the invention. Furthermore, the present invention is not limited to the described methods, embodiments, features or combinations of features but include all the variation, methods, modifications, and combinations of features within the scope of the appended claims, thus the invention is limited only by the claims.

What is claimed is:

1. A sump-pump basin cover, comprising:

a water-tight, impermeable, non-mechanical, sump-pump basin cover, constructed for being water-tightly sealed using a gasket (18*c*) directly to a floor surrounding a sump-pump basin opening, further comprising, a first aperture through said cover to receive and engage in a water-tight manner a vertically oriented discharge pipe through which water in the sump-pump basin is pumped by a sump-pump to an outside drain providing for a water-tightly sealed water-tight sump-pump basin cover back-up device that prevents water in the sump-pump basin from flooding the floor adjacent to the sump-pump basin, while retarding the escape of pump noise, odor, and radon and other gases that are known to emanate from sump-pump basins, and a second aperture (16*c*) extending through said cover, said cover and said second aperture structured to be at or just below the floor surface, said second aperture having a removable water-tight cover (16*d*) so as to provide for drainage of water from the floor about the sump-pump basin into the sump-pump basin when, and only when, the water-tight cover (16*d*) is removed, and said cover comprising a first (14) and a second (12) cover section, said first section being independently removable from said sump-pump basin to provide access to the interior thereof, said second cover section (12) having a first cover section receiving aperture (12*b*) located therethrough for receiving and being water-tightly sealed to said first cover (14) section.

2. The sump-pump basin cover, as recited in claim 1, wherein said first aperture for the passage of the discharge pipe is in said second section.

3. The sump-pump basin cover as recited in claim 1, wherein said first aperture for the passage of the discharge pipe is in said first section.

4. The sump-pump basin cover as recited in claim 3, wherein said second section is functionally constructed to be detachably attachable to the recessed rim of the sump-pump basin opening in the concrete floor or to be fixedly attached to the sump-pump basin opening in the concrete floor.

5. The sump-pump basin cover as recited in claim 3, further comprising a water alarm as a safeguard against a pump failure.

6. The sump-pump basin cover as recited in claim 1, further comprising an auxiliary discharge pipe functionally connected to an auxiliary power sump-pump operatively situated within said sump-pump basin.

7. The sump-pump basin cover as recited in claim 6, wherein said auxiliary discharge pipe is made of transparent material to monitor the level of the water or of an non-transparent material, if desired.

8. The sump-pump basin cover as recited in claim 7, wherein said auxiliary discharge pipe has a predetermined height, providing for said pipe to function as a relief valve.

9. The sump-pump basin cover as recited in claim 1 further comprising a siphoning port.

* * * * *